United States Patent [19]

Draper et al.

[11] 4,246,631

[45] Jan. 20, 1981

[54] VEHICLE HEADLAMP

[75] Inventors: Geoffrey R. Draper, Lichfield; David A. Birt, Cannock, both of England

[73] Assignee: Lucas Industries Limited, Birmingham, England

[21] Appl. No.: 39,008

[22] Filed: May 14, 1979

[30] Foreign Application Priority Data

May 23, 1978 [GB] United Kingdom ..... 21587/78

[51] Int. Cl.[3] ..... F21V 7/00

[52] U.S. Cl. ..... 362/309; 362/299; 362/347

[58] Field of Search ..... 362/299, 304, 305, 308, 362/309, 341, 343, 347

[56] References Cited

U.S. PATENT DOCUMENTS

| | | | |
|---|---|---|---|
| 1,208,456 | 12/1916 | Bell | 362/309 |
| 1,275,120 | 8/1918 | Ballman et al. | 362/308 |
| 2,568,494 | 9/1951 | Geissbuhler | 362/309 |
| 2,770,716 | 11/1956 | Kingery | 362/309 |
| 3,350,556 | 10/1967 | Franck et al. | 362/309 |

FOREIGN PATENT DOCUMENTS

| | | | |
|---|---|---|---|
| 189285 | 5/1956 | Austria | 362/304 |
| 100352 | 11/1964 | Denmark | 362/299 |

*Primary Examiner*—Monroe H. Hayes

*Attorney, Agent, or Firm*—Ladas & Parry

[57] ABSTRACT

A vehicle headlamp for producing a Z-beam pattern has a reflector provided with a reflective area lying on a surface defined by rotating an ellipse about an axis which passes through the inner focus of the ellipse and which is inclined an acute angle (1°–2°) to the focal axis of the ellipse. A shielded filament for producing an inclined cut-off line to the beam is used and is orientated in the opposite sense to that in which it is orientated in a conventional headlamp for producing an inclined cut-off. Lensing at the front of the reflector splits the area of the basic beam pattern immediately below a horizontal portion of the cut-off line into parts which define upper and lower, mutually laterally displaced horizontal cut-off portions in the required Z-beam pattern. The lensing also utilizes a part-circular cut-off portion of the basic beam produced by the reflector and bulb to define an inclined portion of the Z-beam and depress and/or shifts other portions of the basic beam to reinforce other portions of the Z-beam.

4 Claims, 9 Drawing Figures

FIG.1.
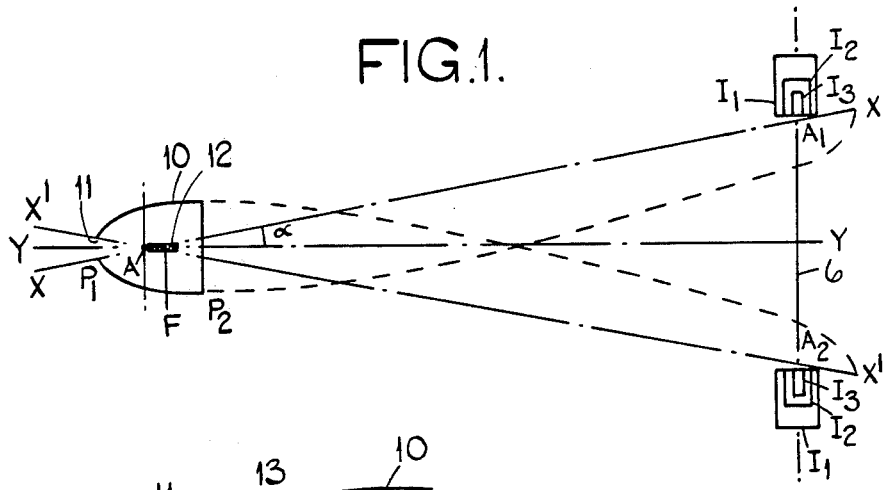
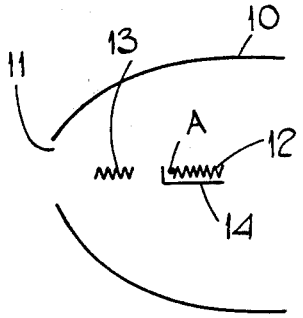
FIG.2.
FIG.3.
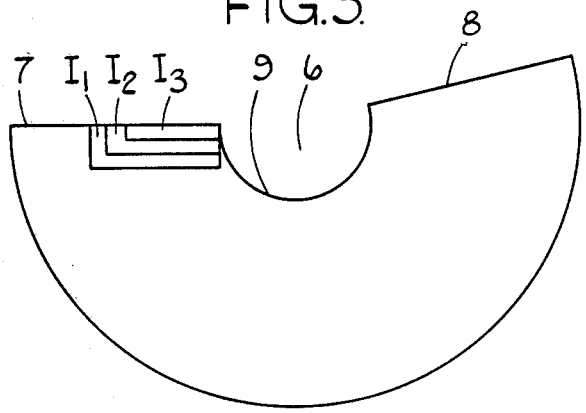

VEHICLE HEADLAMP

This invention relates to a vehicle headlamp and is more particularly concerned with a vehicle headlamp which is aimed at attaining the conditions for a passing beam pattern specified in E.C.E. Regulations 8, 20 and 31 to be attained. Hereinafter, such a passing beam pattern will be referred to as a Z-beam pattern because it basically consists of a beam having its top defined by a light cut-off line having an upper horizontal portion, a lower horizontal portion displaced laterally from the upper horizontal portion, and an inclined portion joining the upper and lower horizontal portions. The above E.C.E. Regulations specify a certain light intensity ratio between a point (HV in the relevant E.C.E. Regulations) above the cut-off line and a point (75L in the relevant E.C.E. Regulations) below the cut-off line. The Z-beam pattern has been specified as a preferred beam pattern in the E.C.E. Regulations in order to reduce dazzle and increase the passing beam range compared with the conventional European passing beam pattern whose upper cut-off line is constituted by a substantially horizontal portion and an inclined portion extending upwardly from one end of the substantially horizontal portion. In this conventional European passing beam pattern (hereinafter referred to as a passing beam having an inclined cut-off), there is also specified a certain light intensity ratio between points (HV and 75L, respectively) above and below the cut-off line.

With a conventional vehicle headlamp, the passing beam pattern having an inclined cut-off can be attained by providing a paraboloidal reflector in which is mounted a passing beam filament and light shield arrangement which produces a basic (i.e. unlensed) beam pattern having a cut-off line consisting of a substantially horizontal portion, an upwardly inclined portion, and a part-circular portion which connects the inclined and substantially horizontal portions. Lensing on the headlamp then modifies this basic beam pattern to produce the required passing beam pattern having an inclined cutoff by shifting portions of the beam inwardly to "fill in" the part-circular cut-off line between the inclined and substantially horizontal portions. A suitable passing beam filament and shield for producing the basic beam pattern with a paraboloidal reflector is provided in a quartz halogen bulb designated as an H4 bulb. These bulbs are widely available commercially. The beam pattern having an inclined cut-off must, of course, be orientated in the correct sense having regard to the rule of the road in the country for which the vehicle headlamp is intended. Thus, in the case where the vehicle headlamp is intended for use on British roads, the beam pattern is orientated so that the substantially horizontal portion is disposed on the right-hand side of the upwardly inclined portion when viewing the beam from behind the headlamp. In the case of countries, such as France, where the vehicles are driven on the right-hand side of the road, the horizontal portion of the cut-off line will be disposed on the left-hand side of the upwardly inclined portion when the beam is viewed from behind the headlamp.

The Z-beam pattern is specified, as mentioned hereinabove, in order to reduce dazzle to road users travelling in the opposite direction and to increase the range of the passing beam compared with the conventional European passing beam having an inclined cut-off.

The problem with such a Z-beam pattern is that it is not possible to produce the required shape to the cut-off as well as the required HV/E75L ratio by the use of lensing when starting with a conventional paraboloidal reflector with a conventional type of bulb, such as a quartz halogen H4 bulb. In view of the very wide availability of H4 bulbs and in view of the fact that the conventional European passing beam having an inclined cut-off is not superseded, but merely supplemented, by the Z-beam pattern specification, it is envisaged that bulbs, such as the H4 bulb, will be widely available for some period of time. Accordingly, the Applicants have conducted extensive investigations into the problem of obtaining a Z-beam pattern from a vehicle headlamp using a conventional bulb having a shielded passing beam filament which is mass produced for use in headlamps projecting the conventional European passing beam having an inclined cut-off.

According to the present invention, there is provided a vehicle headlamp comprising a dished reflector which receives, in use, a passing beam filament and shield arrangement producing, with the reflector, a basic beam pattern having an opposite side, inclined cut-off (as defined herein) in use, said dished reflector having a reflective area lying on a surface defined by rotating an ellipse about an axis which passes through the inner focus of the ellipse and which is inclined at an acute angle to the focal axis of the ellipse, and lensing arranged to diffract the basic beam pattern in use, said lensing being arranged (a) to split the area of basic beam pattern immediately below the substantially horizontal portion of the cut-off line into parts which define the upper and lower, mutually laterally displaced horizontal cut-off portions in the required Z-beam pattern, (b) to utilise part of the part-circular portion of the cut-off to the basic beam pattern to define the inclined portion joining the upper and lower portions in the required Z-beam pattern, (c) to depress an area of the basic beam pattern below the inclined portion of the cut-off thereof and (d) to shift laterally part of the basic beam pattern below the inclined portion of the cut-off thereof so as to increase the intensity of that portion of the Z-beam pattern which is below the junction between the upper horizontal cut-off portion and the inclined portion.

By the term "basic beam pattern" as used herein is meant the unlensed beam pattern produced by the combination of reflector and passing beam filament and shield arrangement. By the expression "opposite side, inclined cut-off" as used herein is meant a cut-off line to the top of the basic beam which comprises a substantially horizontal portion, an upwardly inclined portion spaced to one side of the substantially horizontal portion and a part-circular portion joining the two aforesaid portions, with the inclined and horizontal portions being so mutually arranged as to correspond with their arrangement in the basic beam pattern required for driving on the opposite side of the road to that for which the vehicle headlamp is intended.

Thus, in accordance with the present invention, the use of a paraboloidal reflector is avoided; a conventional type of bulb can be used, but is orientated within the reflector in the opposite sense to that which is normal having regard to the side of the road on which a motor vehicle fitted with the headlamp is to be driven; and the lensing arrangement is totally different from a conventional lensing arrangement for producing a conventional E.C.E. passing beam pattern with an inclined cut-off. The lensing in a vehicle headlamp according to the present invention diffracts the more important portions of the basic beam pattern in a manner which is totally contrary to the normal practice of lensing of a basic beam pattern.

The use of a dished reflector having the shape defined hereinabove, rather than a paraboloidal shape means that a more advantageous light intensity of the images in the basic beam pattern is obtained for producing the required Z-beam pattern, as will be apparent hereinafter.

Preferably, said part of the basic beam pattern which is laterally shifted to increase the intensity of said portion of the Z-beam pattern below the junction between the upper horizontal cut-off portion and inclined cut-off portion is one in which the filament images are horizontally disposed. This portion of increased intensity includes the point 75L specified in E.C.E. Regulations.

In a preferred embodiment, the lensing comprises (i) a first lensing portion which is arranged to receive light from a peripheral reflector part which produces filament images forming part of the basic beam immediately below the substantially horizontal portion of the cut-off line, said first lensing portion being arranged to lift and shift inwardly the light passing therethrough; and (ii) a second lensing portion which is disposed inwardly of the first lensing portion so as to receive images from a part of the reflector disposed inwardly of said peripheral reflector part, said second lensing portion being arranged to depress and shift light passing therethrough through the axis of the reflector, the inclined portion of the required Z-beam pattern being defined by the inner end of filament images passing through the first lensing portion.

Preferably also, the lensing further includes a third lensing portion which is arranged to receive light from a peripheral part of the reflector on the opposite side thereof to the first-mentioned peripheral reflector part, said third lensing portion being arranged to effect step (d) hereinabove whereby only the smaller filament images are shifted to below said junction between the upper, horizontal cut-off portion and the inclined cut-off portion in the required Z-beam pattern; and a fourth lensing portion disposed inwardly of the third lensing portion and arranged to depress and spread of larger images constituting part of the basic beam defining the inclined cut-off.

It will be well appreciated by a person skilled in the art, the form the various portions of the lensing should take in order to produce the specified effects, one these effects are realised.

An embodiment of the present invention will now be described, by way of example, with reference to the accompanying drawings, in which:

FIG. 1 is a schematic illustration of a lamp reflector forming part of a vehicle headlamp according to the present invention, showing the packing of images obtained by the reflector from a shielded passing beam filament;

FIG. 2 is a schematic illustration of the reflector illustrated in FIG. 1 showing the relative positions in the reflector of the shielded passing beam filament and a main beam filament;

FIG. 3 is a schematic illustration of the basic beam pattern produced by the reflector of FIGS. 1 and 2 using the shielded passing beam filament;

Figure 4:
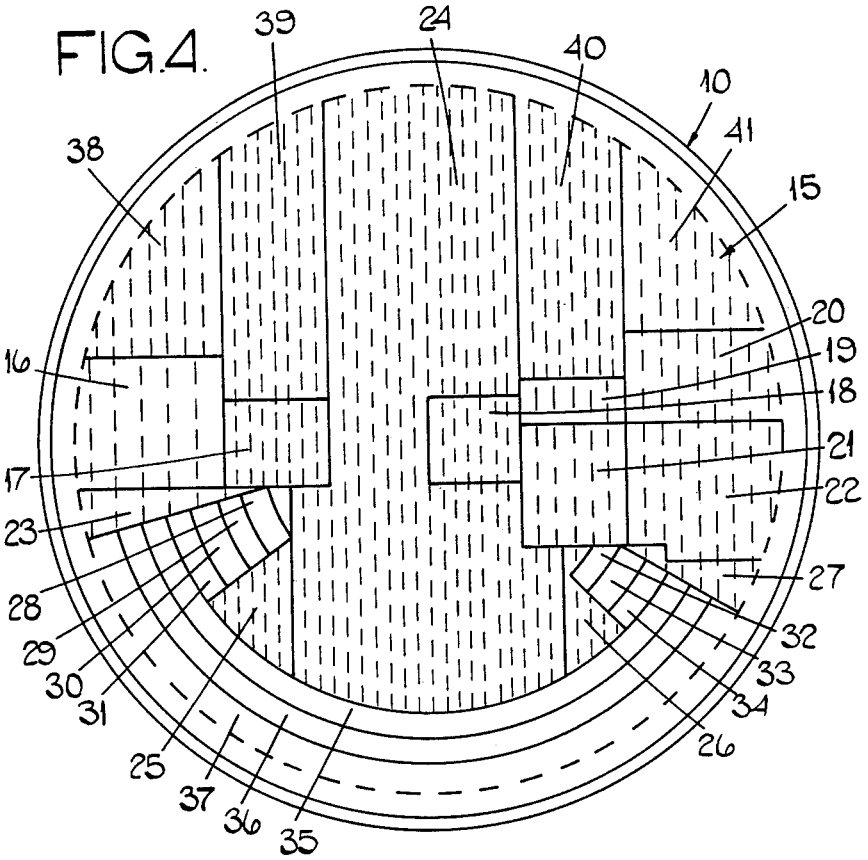
FIG. 4 is a front view of a vehicle headlamp according to the present invention incorporating the lamp reflector of FIGS. 1 and 2 and including the lensing for modifying the basic beam pattern produced by the reflector.

Referring now to FIGS. 1 and 2 of the drawings, the lamp reflector 10 illustrated therein is dished and has an internal reflective surface defined by rotating part of an ellipse about an axis Y—Y which passes through the inner focus A of the ellipse and which is inclined at an angle $\alpha$(in this embodiment, 1 degree) with respect to the major axis of the ellipse. Rotation of the ellipse in this manner produces an infinite number of outer foci $A_1$, $A_2$ lying in a ring. Thus, the reflector 10 is made up of an infinite number of ellipses disposed around the axis Y—Y with their major axes each disposed at the angle $\alpha$ to the axis Y—Y and each having its inner focus coincident with A. In FIG. 1, a horizontal section of the reflector 10 is illustrated, the reflector surface extending on each side of the axis Y—Y from point $P_1$ and $P_2$. A hole 11 is provided at the rear of the reflector 10 for receiving a bulb (not shown). In this embodiment, the bulb is a completely conventional quartz halogen bulb known as an H4 bulb. The quartz halogen bulb is provided with a passing beam filament 12 (FIGS. 1 and 2) and a main beam filament 13 (only shown in FIG. 2). The passing beam filament 12 is disposed with its inner end coincident with A. The passing beam filament 12 is provided with a shield 14 thereunder whose shape is known per se. The shield 14 is provided as part of the H4 bulb. The front end of the main beam filament 13 is spaced behind the inner focus A. The filaments 12 and 13 lie on the axis Y—Y. An opening at the front (i.e. the end of the reflector remote from the hole 11) of the reflector 10 is closed by a lens element 15 (not shown in FIGS. 1 and 2 but shown in FIG. 4). On the right-hand side of FIG. 1 there is shown the image packing obtained by the reflector 10 at a plane which lies at the outer foci $A_1$,$A_2$ . . . etc. $A_1$ and $A_2$ are spaced apart horizontally on opposite sides of the axis Y—Y by a distance which depends upon the angle and the focal length of the ellipses. The ellipses shown in FIG. 1 have respective focal axes X—X and X′—X′.

With the above described construction of reflector 10 and arrangement of passing beam filament 12, a basic passing beam is produced in which images $I_1$, $I_2$ and $I_3$ from each elliptical portion of the reflector 10 have ends corresponding to the inner end of the filament 12 coincident with the respective outer focus $A_1$, $A_2$ etc. Thus, without any lensing or shielding, a toroidal beam pattern is projected by the reflector 10 in which the maximum light intensity is at the inner periphery thereof around a hole 6. There is a sharp cut-off of light around the hole 6. The provision of the shield 14 enables a basic beam pattern of the type illustrated in FIG. 3 to be produced where, in accordance with conventional practice, the shield 14 produces a cut-off to the top of the beam. The cut-off is comprised by a line consisting of a substantially horizontal linear portion 7, an upwardly inclined linear portion 8 disposed at an angle of 15 degrees to the horizontal and a part-circular portion 9 which joins the portions 7 and 8 and which bounds part of the hole 6. The shape of this basic beam pattern is virtually identical to that obtained by a conventional arrangement of paraboloidal reflector and H4 bulb except, of course, that the arrangement of the images $I_1$, $I_2$ and $I_3$ within the basic beam pattern is different in that their inner ends are coincident upon the part-circular portion 9 of the cut-off line. It is to be appreciated that, in a conventional paraboloidal reflector, a beam pattern is obtained in which the images do not have their inner ends coincident with the part-circular portion 9 of the cut-off line. The manner in which the basic beam pattern illustrated in FIG. 3 is modified to produce a Z-beam pattern (FIG. 5) will now be described with reference to FIGS. 4 to 9.

Figure 7:
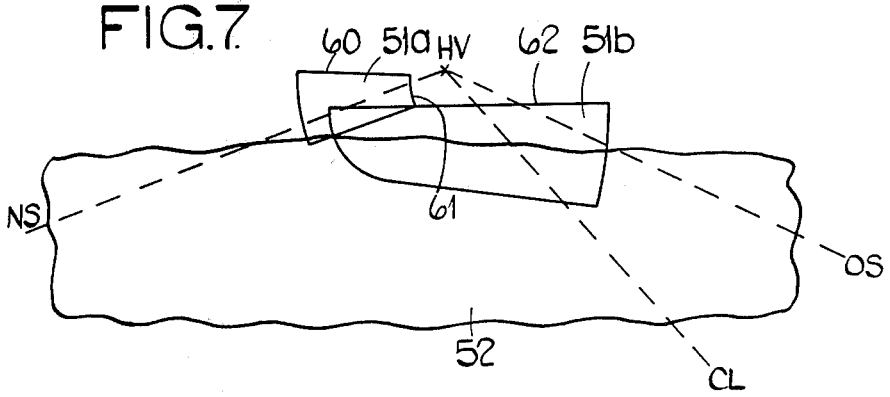
FIG. 7 is a schematic illustration showing how two parts of the basic beam pattern are shifted to produce the required cut-off line.

Referring first to FIG. 4, the lens element 15 has various lens portions 16 to 41. The basic beam pattern projected by the unlensed reflector 10 from the passing beam filament 12 is shown notionally split into three basic parts 51, 52 and 53, of which part 51 is sub-divided into parts 51*a* and 51*b*, and superimposed upon a schematic representation of a road where the line NS corresponds to the nearside kerb of the road, the lines OS corresponds to the offside kerb of the road and the line CL corresponds to the centre of the road. O represents the optical axis of the reflector and corresponds to the axis Y—Y illustrated in FIG. 1. HV corresponds to a specified low intensity standard beam photometry point in the appropriate E.C.E. Regulations. The portion 51*a* of the part 51 is a portion which contains the smaller filament images $I_3$ whereas the portion 51*b* contains the larger filament images $I_1$ and is produced by a portion of the reflector 10 which is disposed inwardly of a peripheral portion which produces the smaller images in portion 51*a*. In use, the filament images in the portion 51*a* passes through the lens portion 16. The lensing in the portion 16 is arranged to displace the images passing therethrough ½ degree to the right and ½ degree up from the position illustrated in FIG. 6. The resultant position of the portion 51*a* is illustrated in FIG. 7. Light from the portion 51*b* passes through the lens portion 17 which has lensing therein arranged to displace the portion 51*b* 5 degrees to the right and also to spread the image horizontally.

After lensing, the upper edge of the portions 51*a* defines the desired upper horizontal portion of the cut-off to the final Z-beam pattern. This upper horizontal portion is identified by reference numeral 60 in FIG. 7. After lensing, the inner end of the portions 51*a* (i.e. a part defining part of the part-circular portion 9 of the basic beam pattern) defines the inclined portion of the cut-off to the final Z-beam pattern. This inclined portion is identified by the reference numeral 61 in FIG. 7. The portion 51*b*, after lensing, defines the lower horizontal portion of the final Z-beam pattern. This lower horizontal portion is identified by the reference numeral 62 in FIG. 7. Those portions 60 and 62 very closely correspond to the upper and lower horizontal cut-off lines 63 and 64 of the required Z-beam pattern illustrated in FIG. 5 whilst the portion 61 corresponds to the desired inclined portion 65 shown in FIG. 5.

The portion 52 of the basic beam pattern emanates from the upper portion of the reflector and passes through the lens portions 24, 38, 39, 40 and 41. Basically, the lens portions 24, 38, 39, 40 and 41 provide a wide spread to the portion 52 of the basic beam pattern to produce the spread outline 52 illustrated in FIG. 7. As can be seen in FIG. 7, this portion 52 is disposed below the lower horizontal cut-off portion 62.

Figure 8:
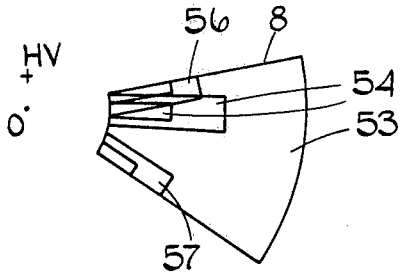
FIG. 8 is a schematic illustration showing the image distribution in a further part of the basic beam pattern illustrated in FIG. 6.
Figure 9:
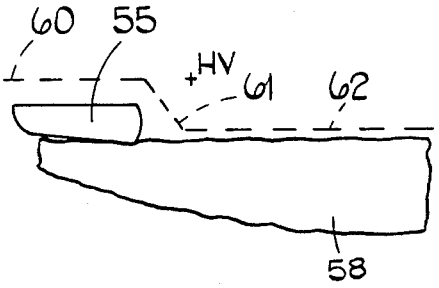
FIG. 9 is a schematic illustration showing the images illustrated in FIG. 8 after lensing.

The manner in which the images in portion 53 of the basic beam pattern are dealt with is illustrated in FIGS. 8 and 9. Images 54 in the portion 53 which are horizontally disposed are lensed 4 degrees to the left and ¼ degree down by passing through the lens portion 20. It will be appreciated that the lens portion 20 diffracts only the relatively small images emanating from the periphery of the reflector 10 on the opposite side thereof to the images which define the portion 51*a* of the basic beam pattern. The images 54 in being so diffracted by the lens portion 20 appear in the final beam pattern in area 55 (see FIG. 9). Area 55, as will be seen includes the standard beam photometric point designated as 75L in FIG. 5. The larger horizontally disposed images in the beam portion 53 pass through the lens portion 19 to be diffracted ½ degree down and spread both horizontally and vertically. Images 56 in the beam portion 53 are upwardly inclined and disposed immediately below the inclined portion 8 of the cut-off line to the basic beam pattern. The smaller images 56 pass through the lens portion 22 whilst the larger images 56 pass through the lens portion 21. The lens portion 21 is formed so as to produce image inverting and horizontal and vertical spreading. To effect image inverting, it lenses ½ degree down at the top and 1½ degrees down at the bottom. The lens portion 22 is similarly formed except that it lenses ¼ degree down at the top and 1 degree down at the bottom. Images 57 in the beam portion 53 are downwardly inclined and are spread both vertically and horizontally by the lens portions 40 and 41. The net result of the diffraction of the images 56 and 57 is to produce a broad spread of light in area 58 illustrated in FIG. 9. Ideally, the upper edges of areas 55 and 58 coincide respectively with the upper horizontal portion 60 and the lower horizontal portion 60 and the lower horizontal portion 62. However, due to permitted tolerances in the H4 bulb, the upper edges of the areas 55 and 58 are disposed below the lines 60 and 62 respectively in order to prevent breakthrough of images above the lines 60 and 62. The remaining parts of the lens element 15 constituted by lens portion 23, the lower portion of lens portion 24, and the lens portions 25 to 37 will not be described in any further detail except to state that the lens portions 23 and 27 are merely for styling purposes and the lens portions 24, 25, 26 and 28 to 37 are provided for use only under main beam conditions. Under main beam conditions, light emanates from the filament 13 rather than the filament 12 and this is relatively unshielded so that the whole of the reflector is used. In this event, the lens portions 24, 25, 26 and 28 to 37 are used to diffract the beam projected by the headlamp so as to fill in the areas of the required beam which are of insufficient intensity. It will be appreciated that, as in all cases where a headlamp is intended for use under dipped and full beam conditions, the beam pattern under full beam conditions is a compromise having regard to the lensing which is already provided for use under passing beam conditions.

Figure 5:
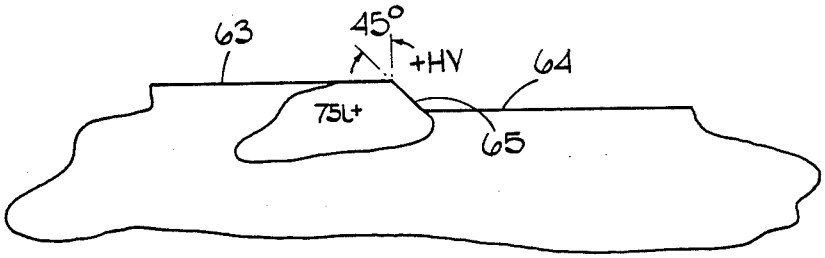
FIG. 5 is a schematic illustration of the most important part of a Z-beam pattern required to be produced.
Figure 6:
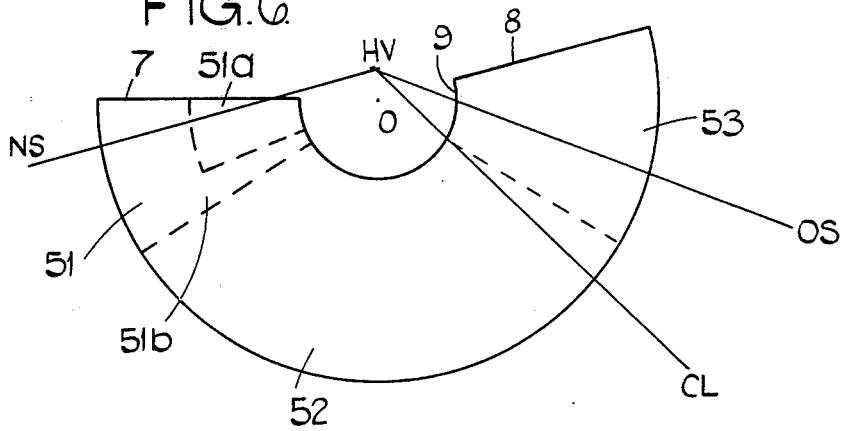
FIG. 6 is a schematic illustration of the basic beam pattern of FIG. 3 showing, in dotted line, the basic manner in which it is notionally divided for lensing.

It will be appreciated from a comparison of FIGS. 3 and 5 that the basic beam pattern produced and illustrated in FIG. 3 is more appropriate, when conventionally lensed, for use in providing a conventional European beam with an inclined cut-off for use in countries where the motor vehicles are driven on the right-hand side of the road. However, as will be appreciated from FIG. 7, the resultant Z-beam pattern produced is intended for use in countries, e.g. in Great Britain, where motor cars are driven on the left-hand side of the road. Although the headlamp described hereinabove with reference to the drawings is one having a circular front opening, it is to be appreciated that, mutatis mutandis, the invention is also applicable to headlamps having a substantially rectangular front opening. In such an event, it is preferred for the angle $\alpha$ to be approximately 1.5 degrees. Of course, the lens element for a reflector having a substantially rectangular front opening will be of rather different shape from the individual portions described with reference to FIG. 4. However, the basic principles in designing the lens element for a rectangular headlamp are the same as those for a circular headlamp in that the various portions of the basic beam pattern projected by the reflector are diffracted in the manner described hereinabove in order to produce the required Z-beam pattern.

$\alpha$ can vary, however, from 1 degree to 2 degrees depending upon the shape and size of reflector chosen. Above about 2 degrees, there is a tendency for the intensity of the images to be lowered whereas below 1 degree gives problems of light scatter above the cut-off. The rear end of the passing beam filament is usually located on the inner focus of the reflector since movement of the filament nearer to the hole 11 at the rear of the reflector causes light scatter above the cut-off but increases the light intensity. On the other hand, movement of the filament further away from the hole 11 at the rear of reflector increases the sharpness of the cut-off but reduces the intensity.

We claim:

1. A vehicle headlamp comprising a dished reflector which receives, in use, a passing beam filament and shield arrangement producing, with the reflector, a basic beam pattern having an opposite side, inclined cut-off (as defined herein) in use, said dished reflector having a reflective area lying on a surface defined by rotating an ellipse about an axis which passes through the inner focus of the ellipse and which is inclined at an acute angle to the focal axis of the ellipse, and lensing arranged to diffract the basic beam pattern in use, said lensing being arranged (a) to split the area of the basic beam pattern immediately below the substantially horizontal portion of the cut-off line into parts which define the upper and lower, mutually laterally displaced horizontal cut-off portions in the required Z-beam pattern, (b) to utilise part of the part-circular portion of the cut-off to the basic beam pattern to define the inclined portion joining the upper and lower portions in the required Z-beam pattern, (c) to depress an area of the basic beam pattern below the inclined portion of the cut-off thereof and (d) to shift laterally part of the basic beam pattern below the inclined portion of the cut-off thereof so as to increase the intensity of that portion of the Z-beam pattern which is below the junction between the upper horizontal cut-off portion and the inclined portion.

2. A vehicle headlamp as claimed in claim 1, wherein said part of the basic beam pattern which is laterally shifted to increase the intensity of said portion of the Z-beam pattern below the junction between the upper horizontal cut-off portion and inclined cut-off portion is one in which the filament images are horizontally disposed.

3. A vehicle headlamp as claimed in claim 1, wherein the lensing includes (i) a first lensing portion arranged to receive light from a peripheral reflector part which produces filament images forming part of the basic beam immediately below the substantially horizontal portion of the cut-off line, said first lensing portion being arranged to lift and shift inwardly, the light passing therethrough; and (ii) a second lensing portion which is disposed inwardly of the first lensing portion so as to receive images from a part of the reflector disposed inwardly of said peripheral reflector part, said second lensing portion being arranged to depress and shift light passing therethrough through the axis of the reflector, the inclined portion of the required Z-beam pattern being defined by the inner end of filament images passing through the first lensing portion.

4. A vehicle headlamp as claimed in claim 3, wherein the lensing further includes a third lensing portion which is arranged to receive light from a peripheral part of the reflector on the opposite side thereof to the first-mentioned peripheral reflector part, said third lensing portion being arranged to effect step (d) hereinabove whereby only the smaller filament images are shifted to below said junction between the upper, horizontal cut-off portion and the inclined cut-off portion in the required Z-beam pattern; and a fourth lensing portion disposed inwardly of the third lensing portion and arranged to depress and spread of larger images constituting part of the basic beam defining the inclined cut-off.

* * * * *